United States Patent [19]

Giocastro

[11] Patent Number: 4,616,561

[45] Date of Patent: Oct. 14, 1986

[54] VENTED HEADING FOR WINDOW UNIT

[76] Inventor: James Giocastro, 53-11 73rd St., Maspeth, N.Y. 11378

[21] Appl. No.: 798,836

[22] Filed: Nov. 18, 1985

[51] Int. Cl.[4] ..... E06B 7/02

[52] U.S. Cl. ..... 98/97; 52/209; 98/98

[58] Field of Search ..... 52/209; 49/408, 70; 98/98, 97, 99.1, 99.01, 99.6

[56] References Cited

U.S. PATENT DOCUMENTS

| | | | |
|---|---|---|---|
| 992,055 | 5/1911 | Pomerantz | 98/97 |
| 1,187,551 | 6/1916 | Reiss | 98/97 |
| 1,369,566 | 2/1921 | Smidley | 98/98 X |
| 3,255,688 | 6/1966 | Iwata | 98/97 X |

FOREIGN PATENT DOCUMENTS

| | | | |
|---|---|---|---|
| 1028317 | 4/1958 | Fed. Rep. of Germany | 98/97 |
| 1210222 | 10/1970 | United Kingdom | 98/98 |
| 1422970 | 1/1976 | United Kingdom | 98/99.01 |
| 2074716 | 11/1981 | United Kingdom | 98/97 |

*Primary Examiner*—William F. Pate, III
*Assistant Examiner*—Jean M. LaKemper
*Attorney, Agent, or Firm*—Nicholas J. Garofalo

[57] ABSTRACT

A vented heading for the outer frame of an airtight double-hung sash window unit adapted to be seated in an opening of an exterior wall of an apartment. Vent holes in a head panel allow fresh air flow into the heading; and a baffle member at the back of the heading serves to direct the airflow downwardly at the rear of the unit into the apartment. Stale air from the apartment is enabled to move past the baffle member and escape through the heading and vent holes to the outside.

8 Claims, 6 Drawing Figures

VENTED HEADING FOR WINDOW UNIT

BACKGROUND OF THE INVENTION

This invention is concerned with window units of the airtight double-hung sash type, such as are being currently installed in homes and particularly in apartment buildings. More particularly, it is concerned with the provision of a vented heading for such units.

The conventional airtight window unit has a pair of sash vertically slidable relative to each other to open and closed positions in side tracks of an encasing frame. When closed, the sashes are airtight to the extent of being sealed against entry of outside fresh air and against escape of inside stale air. Further, the sashes are double glazed. This characteristic, together with the airtight feature serves to create an undesirable aerobic condition within the related apartment. It tends to produce, during any period that the windows remain closed, harmful effects not only upon the interior structure of the apartment but also upon its occupants.

Humidity, condensation and dampness develop in apartments having such window units. This is due to a lack of ventilation through the airtight unit when the sashes remain in a closed condition. Resulting mold growth destroys walls, floors and furniture in the apartment. The humidity and condensation, together with periods of excessive dryness destroys walls, paint and wall paper, warps woodwork and doors, and subjects the occupants of the apartment to sore throats, colds and other discomforts.

Accordingly, a general object of the present invention is to provide the conventional airtight window unit with an improvement which will serve to avoid the harmful effects mentioned and will not materially diminish the general purpose for which such airtight window units are intended.

A more particular object of the invention is to provide a vented heading for an airtight double-hung sash window unit which will provide a desirable exchange of stale room air with fresh outside air.

The invention, together with its various advantages will become increasingly apparent as this specification unfolds in greater detail and as it is read in conjunction with the accompanying drawing, wherein a preferred and specific embodiment of the invention is illustrated.

Briefly, in accordance with the invention an airtight window unit of the double-hung sash type is provided with a heading having vent holes fitted with screened vent plugs. The vent plugs allow a desirable degree of exchange of stale room air with outside fresh air through the heading. Before the outside air flows from the heading to the related room, it is acted upon by a baffle member so that it flows gently into the room without creating undesirable drafts. The baffle member, which is a part of the heading, also serves as decorative interior trim at the room side of the window unit. The screened vent plugs may be varied in number so as to provide a controlled and desirable degree of ventillation to the room.

DETAILED DESCRIPTION OF THE INVENTION

Figure 6:
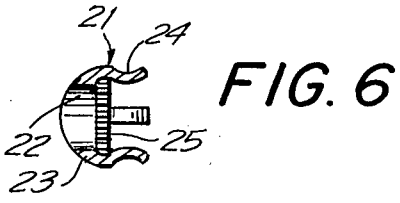
FIG. 6 is a section on line 6—6 of FIG. 5.
Figure 5:
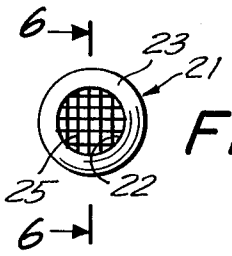
FIG. 5 is an enlarged plan view of the head of one of the vent plugs.
Figure 4:
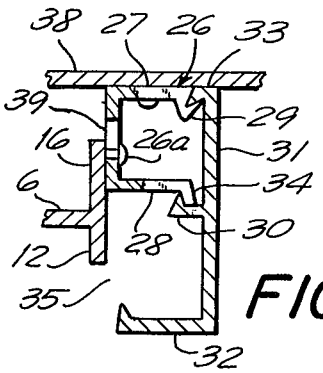
FIG. 4 is an enlarged detail of the baffle member, showing its mounted relation to the heading.
Figure 1:
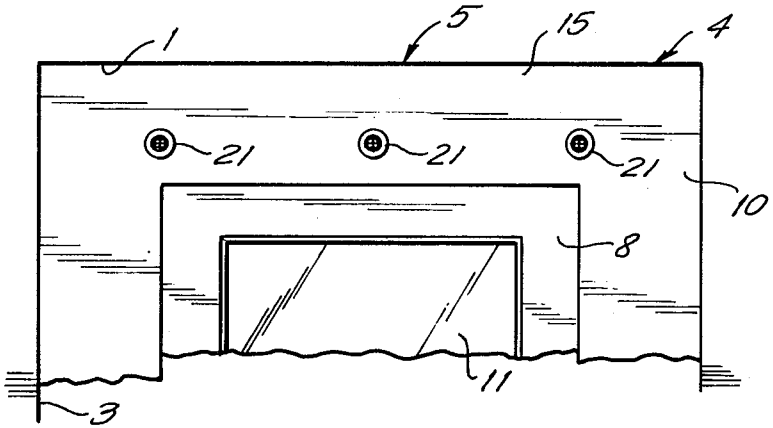
FIG. 1 is an elevational view of the upper front portion of an airtight double-hung sash window unit embodying the invention, the unit being shown as seated in a window opening of an exterior wall of an apartment.

Reference is now directed to the accompanying drawing, wherein there is shown a window opening 1 in an exterior wall 3 of an apartment. The opening is of conventional rectangular form. It has a shoulder 2, here in the conventional form of a Z-bar, extending into the opening from its walls. A window unit 4 is adapted to be entered in the opening and seated against the shoulder. The window unit is an airtight double-hung sash type.

The window unit includes an outer casing or frame 5 having top and side walls 6, 7 and a bottom wall or sill, not shown. The lower portion of the unit is conventional and not shown since the upper portion of the unit is adequate for a clear understanding of the invention.

A pair of complementary double-hung sashes 8, 9 is encased by the frame. These are slidable vertically relative to each other in conventional tracks in the side walls 7. The sashes are shown as being double glazed, as at 11. When closed, the sashes have an airtight relation to each other and to the frame. A short shoulder 12 depending along the rear end of the top wall 6 of the frame serves as a stop for the rear sash member 9. The shoulder 12 also extends down the side walls 7.

The upper end of the frame is defined by a heading 14. This includes the top wall 6 of the frame. A head panel 15 defines a front end to the heading. The head panel is co-extensive with and extends vertically upward from the forward end of the top wall. Mounted to an upwardly extending shoulder 16 of the rear end of the top wall is a baffle member 17 which defines a rear or back to the heading.

The head panel 15 has a plurality of vent holes 18 opening into a space 19 defined between the head panel and the baffle member. Plugged into each vent hole is a vent plug 21 having an axially extending screened hole 22 through its head 23. The plug is formed preferably of metal or plastic material. A group of flexible fingers 24 extend rearwardly from the back of the plug, and a screen 25 is seated at the back of the head over the hole, as appears in FIG. 6. The plug is adapted to be seated in a vent hole 18 by first flexing its fingers and pushing them through the hole until the head of the plug abuts the face of the panel 15. As the fingers project from the rear of the hole, they expand to secure the position of the plug.

The baffle member 17 is removably mounted to a supporting clip 26 that is fastened to the upper shoulder 16 of the top wall of the frame. The clip is of C-form. Its back wall is fixed by a fastener 26*a* to the shoulder. Upper and lower rearwardly extending arms 27, 28 of the clip terminate, respectively, in coupling elements 29, 30. The baffle member is of L-form. It has a vertical elongated panel 31 which extends in part above the top wall 6 and shoulder 16, and in part depends below the top wall and the stop shoulder 12. A relatively narrow arm 32 extends forwardly from the lower end of the panel. Along the upper end of the baffle panel 31 is a coupling element in the form of a hook 33 having a snapped-in engagement with a complementary notch defining the coupling element 29 of the C-clip; and extending off and along the mid-area of the baffle panel is a coupling element in the form of a notch 34 which complements and has a snapped-in engagement with a hook defining the coupling element 30 of the C-clip. The lower arm 32 of the baffle member is spaced, as at 35, below and clear of the stop shoulder 12.

The window unit 4 is seated in the wall opening 1 against the shoulder 2. In this respect, the upper end and sides of the head panel 15 are seated against complementary portions of the shoulder 2. Side panels 10 of the frame 5 are seated against side portions of the shoulder 2. A bottom panel, not shown, of the frame is seated against a lower section of shoulder 2.

The window unit is held seated against the shoulder 2 by means of the clip 26, the upper arm 27 of which is fixed by a fastener to a ceiling wall 38 of the wall opening. A vertical slot 39 in the back wall of the clip enables the clip to be adjustably moved up or down relative to its fastener **26*a* so as to abut the upper arm of the clip against the ceiling wall 38. The fastener 26*a* is tightened after the adjustment is made. Other clips 41, secured to the shoulder stop 12 and to side walls of opening 1, further secure the seated condition of the window unit. Clips 41** have a snapped-in engagement with side trim at the room side of the window unit.

Figure 2:
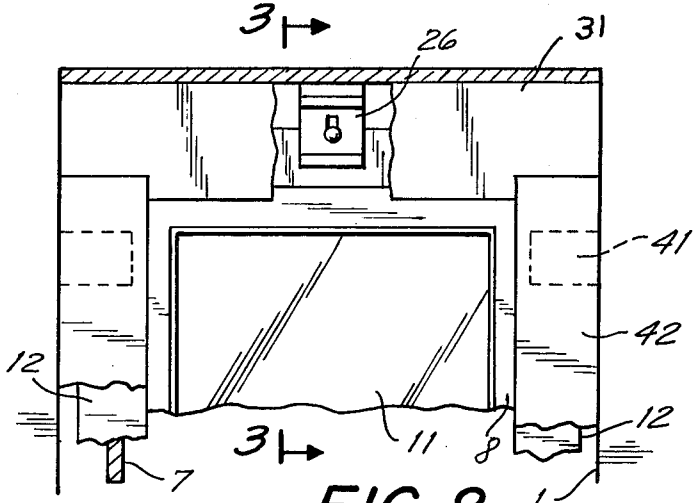
FIG. 2 is an elevational view of the upper rear portion of the window unit at the room side of the wall.
Figure 3:
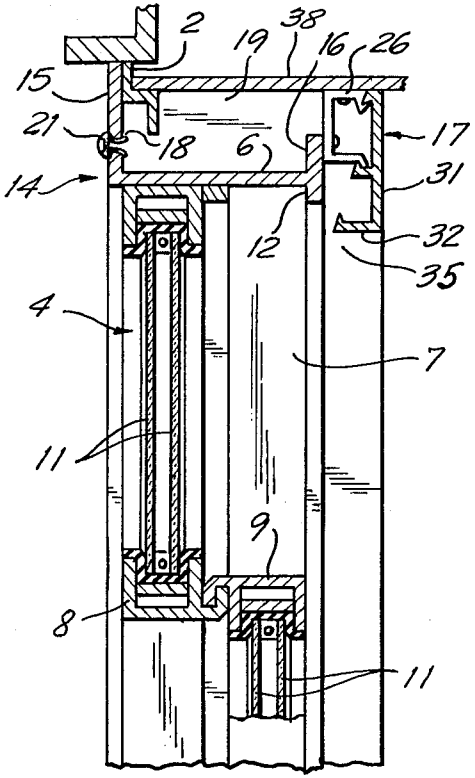
FIG. 3 is a section on line 3—3 of FIG. 2.

The rear of the baffle panel 31 faces the room-side of the seated window unit. In this respect the baffle panel serves not only to baffle incoming air to the room, but also serves as trim for the upper end of the window unit, as in FIG. 2.

It should now be apparent that, by means of the heading 14 provided for the window unit, a desirable degree of ventilation to the room side of the window unit is possible to counteract the undesirable aspects of the airtight window unit. In this respect, fresh air entering through the screened vent plugs 21 flows through the space 19 in the heading toward the baffle panel 31. It is baffled or diverted by the latter downward against and over its lower arm 32 and through the space 35 below the stop shoulder 12 to the interior of the related room. The baffled air flows gently from the space 35 to the room without creating undesirable drafts. Foul air from the room is exchanged through the vented heading with fresh air.

Here, it has been determined that three vent plugs 21 having a screened hole of small diameter, preferably about three-fourths of an inch, provide a desirable degree of air flow through the heading.

It is apparent that the degree of ventilation or air flow through the heading may be controlled by using all of the vent plugs, or by sealing one or more of the vent holes 18 with replacement plugs having a solid head.

The screen 25 in the vent plug serves to block out entry of dust particles and insects through the heading. The head 23 of the vent plug is preferably convexed. This form, together with the relatively small size of the head serves to avert entry of rain through the plug.

While I have described what I consider to be a desirable embodiment of my invention, it is my intent, however to claim all such forms of the invention as may be reasonably construed to be within the spirit of the invention and the scope of the appended claims.

What is claimed is:

1. A window unit adapted to be seated in a window opening of a wall of an apartment, the opening having a ceiling and side walls provided with a shoulder extending into the opening, the window unit including an outer frame having a top wall, a pair of side walls, a pair of double-hung glazed sashes encased in the frame between the side walls, and a shoulder depending from a rear end of the top wall defining a stop for a rearwardly disposed one of the sashes, wherein the improvement comprises a heading for the frame, the heading having a head panel extending upwardly from a front end of the top wall, the head panel adapted to be seated at an upper end and sides thereof against the shoulder extending into the opening, a shoulder extending upwardly from the rear end of the top wall, a baffle panel extending in part upwardly relative to the rear end of the top wall and depending in part below the rear end of the top wall and the stop, the baffle panel defining a back to the heading in opposed spaced relation to the head panel, a clip fastened to the upwardly extending shoulder, the clip being engaged with and supporting the baffle panel in spaced relation to the rear end of the top wall, and the head panel having a plurality of vent holes communicating through the head panel with the space between the head panel and the baffle panel, the vent holes serving to allow air flow into the space between the head panel and the baffle panel, and the baffle panel serving to divert the air flow downwardly through the spacing between the baffle panel and the rear end of the top wall to the apartment side of the sashes, wherein the clip is of C-form comprising a back wall having a vertical slot, a fastener extending through the slot and fixing the clip to the upwardly extending shoulder of the top wall, the clip having an upper rearwardly extending arm engaged with an upper end of the baffle panel, the clip having a lower rearwardly extending arm engaged with the baffle panel, the back wall being vertically adjustable in its position relative to the fastener to seat the upper arm of the clip against the ceiling wall of the wall opening, and the upper arm of the clip being adapted to be fastened to the ceiling wall.

2. A window unit as in claim 1, wherein the baffle panel has a rear face defining an upper decorative trim for the heading at the apartment side of the window unit when the window unit is seated in the wall opening.

3. A window unit as in claim 1, wherein a separate vent plug having a screened axial hole through it is releasably plugged into each vent hole.

4. A window unit including an outer frame having a top wall, a pair of side walls and a pair of complementary double-hung glazed sashes encased in the frame between the side walls, wherein the improvement comprises a heading for the frame, the heading having a head panel extending upwardly from a front end of the top wall, a shoulder extending upwardly from a rear end of the top wall, a baffle panel extending in part upwardly relative to the rear end of the top wall and depending in part below the rear end of the top wall, the baffle panel defining a back to the heading in opposed spaced relation to the head panel, a clip fastened to the upwardly extending shoulder, the clip being engaged with the baffle panel and supporting the baffle panel in spaced relation to the rear end of the top wall, means for securing the frame in a window opening of a wall, and the head panel having a plurality of vent holes communicating through the head panel with the space between the head panel and the baffle panel, the vent holes serving to allow air flow into the space rearwardly of the head panel, and the baffle panel serving to divert the air flow downwardly through the spacing between the baffle panel and the rear end of the top wall, wherein the means for securing the frame in a window opening is an arm part of the clip, the arm being adapted to be fastened to a ceiling wall of the window opening.

5. A window unit as in claim 4, wherein a separate vent plug having a screened axially extending hole through it is releasably plugged into each vent hole.

6. A window unit as in claim 4, wherein the vent holes are three in number.

7. A window unit including an outer frame having a top wall, a pair of side walls and a pair of complementary double-hung glazed sashes encased in the frame between the side walls, wherein the improvement comprises a heading for the frame, the heading having a head panel extending upwardly from a front end of the top wall, a baffle panel extending in part upwardly relative to a rear end of the top wall and depending in part below the rear end of the top wall, the baffle panel defining a back to the heading in opposed spaced relation to the head panel, clip means for supporting the baffle panel in spaced relation to the rear end of the top wall, the clip means being engaged with the baffle panel and having means for securing the frame in a window opening of a wall comprising an arm adapted to attachment to a ceiling wall of the window opening, and the head panel having a vent communicating through the head panel with the space between the head panel and the baffle panel, the vent serving to allow air flow into the space rearwardly of the head panel, and the baffle panel serving to divert the air flow downwardly through the spacing between the baffle panel and the rear end of the top wall.

8. A window unit as in claim 7, wherein the baffle panel has a snapped-in engagement with the clip means.

* * * * *